US006592389B2

(12) United States Patent
Cuevas

(10) Patent No.: US 6,592,389 B2
(45) Date of Patent: Jul. 15, 2003

(54) HIGH-TEMPERATURE MINIMAL (ZERO) INSERTION FORCE SOCKET

(75) Inventor: Peter Cuevas, Los Gatos, CA (US)

(73) Assignee: QualiTau, Inc., Santa Clara, CA (US)

( * ) Notice: Subject to any disclaimer, the term of this patent is extended or adjusted under 35 U.S.C. 154(b) by 0 days.

(21) Appl. No.: 10/160,318

(22) Filed: May 29, 2002

(65) Prior Publication Data

US 2003/0003791 A1 Jan. 2, 2003

Related U.S. Application Data

(60) Provisional application No. 60/301,632, filed on Jun. 27, 2001.

(51) Int. Cl.[7] ..... H01R 4/50
(52) U.S. Cl. ..... 439/342; 439/259
(58) Field of Search ..... 439/342, 72, 259–265, 439/266, 268, 316, 68, 331

(56) References Cited

U.S. PATENT DOCUMENTS 3,932,012 A * 1/1976 Reimer et al. ..... 339/17
3,993,381 A * 11/1976 Horbach ..... 339/17
4,090,667 A * 5/1978 Crimmins ..... 339/19
4,478,472 A * 10/1984 Baar ..... 339/75
4,583,806 A * 4/1986 Tainter, Jr. et al. ..... 339/75
4,679,886 A * 7/1987 King ..... 439/816
4,688,870 A * 8/1987 Egawa et al. ..... 439/331
4,786,256 A * 11/1988 Angeleri et al. ..... 439/72
5,021,000 A * 6/1991 Scheibner ..... 439/342
5,243,757 A * 9/1993 Grabbe et al. ..... 29/882
6,179,640 B1 1/2001 Sikora et al.
6,217,341 B1 * 4/2001 Glick et al. ..... 439/66

* cited by examiner

*Primary Examiner*—Alexander Gilman
(74) *Attorney, Agent, or Firm*—Beyer Weaver & Thomas, LLP

(57) ABSTRACT

A minimal insertion force socket for use in testing DIP integrated circuits having a plurality of leads extending therefrom, the socket plate having a plurality of holes arranged in two parallel rows for receiving the leads from the integrated circuit, and a plurality of wires anchored on the socket plate and arranged in two parallel partially interdigitated sets with each wire cooperating with a hole for engaging a lead of the integrated circuit. The working distance from a lead contact point on each wire to an anchor point on the interdigitated portion of each wire is increased relative to the working distance of aligned wires in the two parallel sets.

11 Claims, 2 Drawing Sheets

Novel Placement and Orientation (Engaged position)

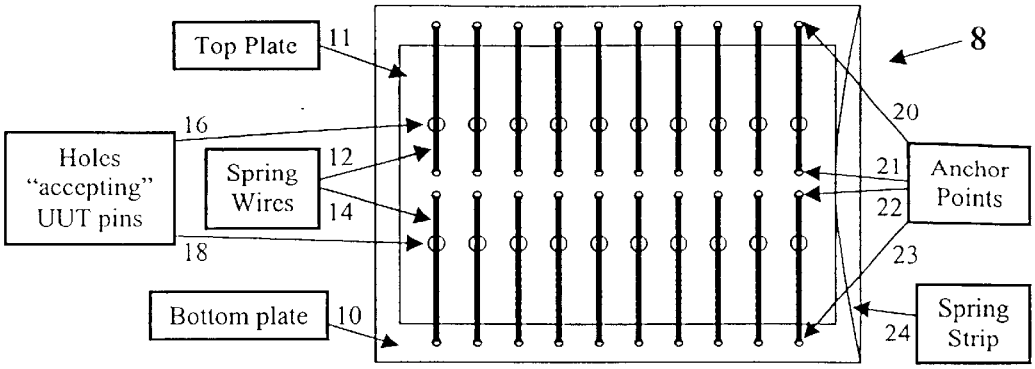
Fig. 1A: Prior Art QualiTau ZIF Socket (Empty position)
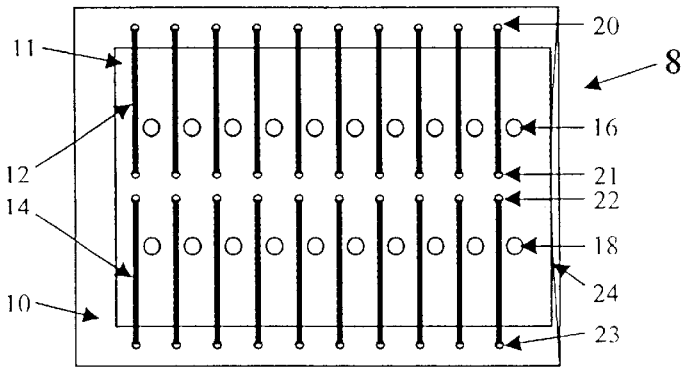
Fig. 1B: Prior Art QualiTau ZIF Socket (Actuated position)
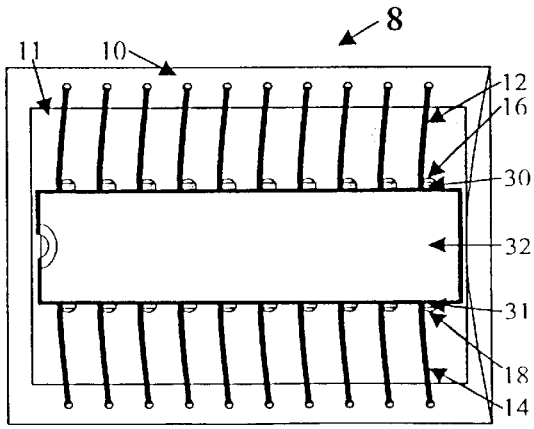
Fig. 2A: Engaged Position (UUT Body Shown)
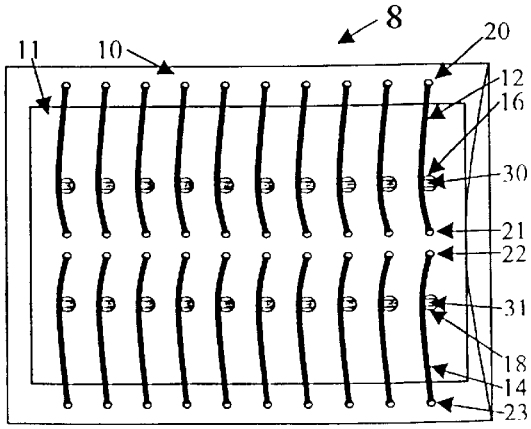
Fig. 2B: Engaged Position (UUT Body Not Shown)

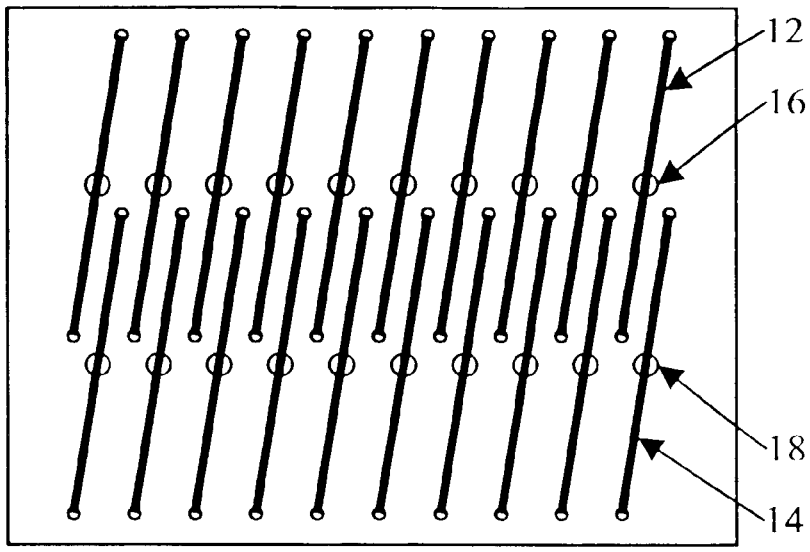
Fig. 3A: Novel Placement and Orientation (Empty position)
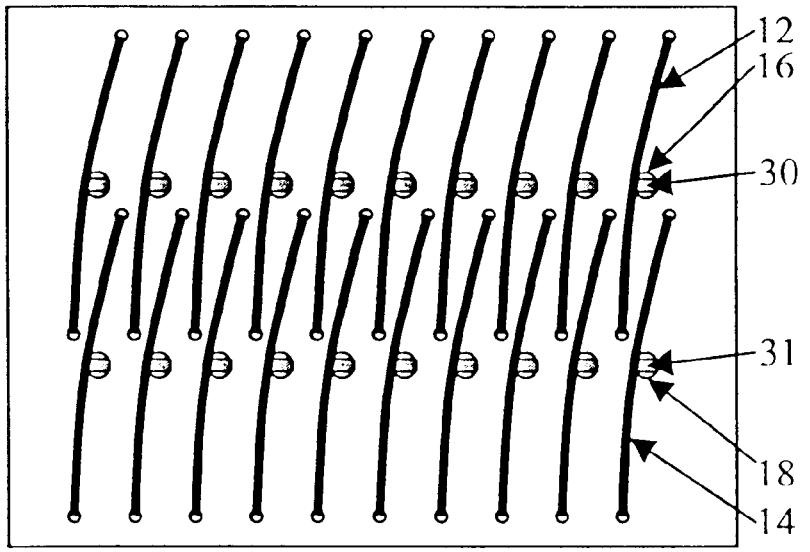
Fig. 3B: Novel Placement and Orientation (Engaged position)

HIGH-TEMPERATURE MINIMAL (ZERO) INSERTION FORCE SOCKET

CROSS-REFERENCES TO RELATED APPLICATIONS

This application claims priority from co-pending provisional application serial No. 60/301,632, filed Jun. 27, 2001 and is related to U.S. Pat. No. 6,179,640, assigned to the present assignee, which are incorporated herein for all purposes.

BACKGROUND OF THE INVENTION

This invention relates generally to the testing of electronic integrated circuits, and more particularly the invention relates to sockets for receiving packaged integrated circuits for test purposes.

The packaged integrated circuit typically includes a polymer or ceramic housing for a semiconductor chip with electrical leads extending from the package which are electrically connected to the semiconductor chip. In a dual in-line package (DIP), the electrical leads are arranged in two parallel rows with the leads depending from the bottom of the housing.

Packaged integrated circuits must undergo a number of different tests, each test requiring the insertion of the integrated circuit package and leads into a test socket. To prevent bending or damage to the leads, zero insertion force (ZIF) sockets have been devised to limit the force exerted on the leads when the package is inserted into a test socket. The most widely known and used ZIF sockets are from 3M Corporation and Aries Corporation. In these sockets the leads of a DIP (dual in-line package) are pinched between two pieces of metal which are, in turn, soldered to a printed circuit board. The metal pieces are held in place by the body of the ZIF socket which is typically made of plastic. The metal pieces are electrically conducting to provide a good electrical path from the DIP lead to the printed circuit board in which the ZIF socket is attached. In all cases, the bodies of these sockets are made of some organic material (plastics or polymers) which can only withstand temperatures as high as 250 degree C. for extended periods of time. The metal used to pinch the leads of the IC DIP packages are beryllium copper alloy or beryllium nickel alloy for a high temperature operation not to exceed 250 degree C. While these sockets perform well within their stated specifications, they cannot be used at temperatures in excess of 250 degree C. because the materials will decompose and fail.

U.S. Pat. No. 6,179,640, assigned to the present assignee, discloses a test socket including two members having planar surfaces arranged to permit relative lateral movement between the two members. One member is a package support and has a plurality of holes extending therethrough for receiving the integrated circuit package leads. Each hole has sufficient size to receive a lead with minimal or no force. The second member is a contact support and has a plurality of contact wires arranged to be in spaced juxtaposition with package leads when a package is inserted into or removed from the support member. The contacts are slidable into engagement with the package leads after the package is inserted.

FIG. 1A is a plan view of contact support 10 of ZIF socket 8 in accordance with '640 Patent with spring wires 12, 14 providing contacts for leads of an integrated circuit package (not shown) which extend through holes 16, 18 in package support 11 of socket 8. Wires 12, 14 are arranged in parallel groups of wire which are anchored to the socket in holes at opposing ends 20, 21 and 22, 23. Vertical separation of the rows of holes 16 and 18 may be 0.3 inch to accommodate an industry standard I.C. package called "narrow DIP". FIG. 1B shows package support 11 slid relative to contact support 10 whereby wires 12, 14 are moved from holes 16, 18 and permit the insertion of leads of an integrated circuit package into holes 16, 18.

FIGS. 2A, 2B represent the same ZIF socket of FIG. 1, but now engaged by leads or pins 30, 31 of UUT 32. For clarity, the main body of UUT 32 has been removed from FIG. 2B to expose the underlying interaction between pins 30, 31 and spring wires 12, 14.

It will be noted that the socket holes 16, 18 are not located midway between the anchor points of the wires, but rather the length of the wire sections that lie underneath the body of the UUT are significantly shorter than the wire sections that lie outside of the UUT 32. This causes the shorter inner wire sections to distort more than the longer outer sections.

In order for the spring wire contacts to perform well, a certain amount of reasonable "working distance" must be provided between the anchor points and the contact points. If the working distance is too small, damage to either the UUT pins or the spring wires can result. Experience shows that the smaller the working distance, the more difficult the overall design of the ZIF mechanism, especially in terms of allowing tolerances of the socket components. Consequently, a low working distance can have significant adverse ramifications in terms of both cost and reliability of the final product.

The present invention is directed to increasing the working distance in such a ZIF socket.

BRIEF SUMMARY OF THE INVENTION

In accordance with the invention, wire contacts in a contact support plate of a ZIF test socket are arranged in two parallel partially interdigitated sets to thereby increase the minimum working distance between contact points on the wire and anchor points at either end of the wire. The wires are inclined with respect to the alignment of lead receiving holes in the package support plate to allow for the interdigitation of the sets of wires. Thus the working distance of the wire under the DIP package is not limited to less than half the width of the package.

The invention and objects and features thereof will be more readily apparent from the following detailed description and dependent claims when taken with the drawing.

BRIEF DESCRIPTION OF THE DRAWINGS

FIGS. 1A, 1B are plan views of a ZIF socket plate and contact wires in accordance with prior art.

FIGS. 2A, 2B illustrate the engagement of UUT leads and contact wires of the contact support plate of FIG. 1.

FIGS. 3A, 3B are plan views of a ZIF socket with contact wires arranged in accordance with one embodiment of the invention, with the wires not engaging leads and engaging leads, respectively.

DETAILED DESCRIPTION OF THE INVENTION

FIGS. 1A, 1B are plan views of a ZIF socket 8 in accordance with the prior art having two sets of wire contacts 12, 14 on contact support plate 10 with each wire extending over a contact hole, 16, 18 of package support plate 11 and with ends of 20, 21 and 22, 23 of the wires being anchored to plate 10. To facilitate viewing of the contact wires 12, 14, top plate 11 for supporting a unit under test is shown transparent. Each of the holes 16, 18 is larger than a lead of the UUT, thus facilitating minimal or zero insertion force. When inserting a UUT and leads into the socket, wires 12, 14 are moved relative to holes 16, 18 whereby holes 16, 18 are unimpeded by wires 12, 14 in receiving UUT leads.

FIGS. 2A, 2B are plan views illustrating the flexing of wire contacts 12, 14 when engaging leads 30, 31 extending from a UUT body 32 mounted on movable support plate 11. Again, for illustration purposes, UUT body 32 is removed from FIG. 2B to illustrate wire contacts 12, 14 engaging leads 30, 31 with the wires being flexed in pressure engagement with the leads.

As described above, it will be noted that the socket holes 30, 31 are not located halfway between anchor points 20, 21 and 22, 23 but rather the length of the wire sections that lie underneath the body of the UUT are significantly shorter than the wire sections which lie outside the UUT outline. This causes the shorter inner wire sections to distort more as compared to the longer outer wire sections when receiving the UUT. In order for the spring wire contacts to perform well, a certain amount of working distance between the contact and anchor points is required. If the working distance is too small, then damage can result to either the UUT pins or the spring wires. Further, a smaller working distance makes the overall design of the ZIF mechanism more difficult, especially in terms of allowed tolerances of socket components. Consequently, a short working distance can have significant ramifications in terms of both cost and reliability of the test socket.

In accordance with the invention, the working distance of the inner wire segments is increased by arranging the sets of wires 12, 14 in a partially interdigitated arrangement, thereby increasing the working distance from a lead contact point on each wire to an anchor point on the inner interdigitated portion of each wire. Again, it will be noted that each wire cooperates with a hole 30, 31 to make contact with a UUT lead. FIG. 3A shows an empty position with wires 12, 14 centrally disposed under the holes 30, 31, while in FIG. 3B wires 12, 14 are in flexed engagement with UUT leads 30, 31 extending through holes 16, 18 and the socket plate 10. In contrast with the prior art socket where wires in the two wire sets are in alignment, the socket in accordance with the invention places the wires at an angle so that the two sets can be at least partially interdigitated to increase the length of the wire sections that lie underneath the body of a UUT. Thus the inner lengths of the wires are not limited to less than half the width of a DIP package.

While the invention has been described with reference to a specific embodiment, the description is illustrative of the invention and is not to be considered as limiting the invention. Various modifications and applications may occur to those skilled in the art without departing from the true spirit and scope of the invention as defined by the appended claims.

What is claimed is:

1. A minimal insertion force socket for use in testing an integrated circuit having a plurality of leads extending therefrom, said socket including a first member having a plurality of holes arranged in two parallel rows for receiving leads from the integrated circuit, and a second member having a plurality of wires anchored on the second member and arranged in two parallel partially interdigitated sets with each wire cooperating with a hole for engaging a lead of the integrated circuit, thereby increasing working distance from a lead contact point on each wire to an anchor point on an interdigitated portion of each wire.

2. The minimal insertion force socket as defined by claim 1 wherein the first member is laterally translatable with respect to the second member.

3. The minimal insertion force socket as defined by claim 1 wherein holes in the two parallel rows are aligned, the two parallel sets of wires being inclined with respect to the alignment of the holes.

4. The minimal insertion force socket as defined by claim 3 wherein opposing ends of each wire are anchored to the second member, the working distance from a lead contact point on each wire to opposing ends of the wire being approximately equal.

5. The minimal insertion force socket as defined by claim 4 wherein the first member is laterally translatable with respect to the second member.

6. A socket for use in testing a packaged integrated circuit having a plurality of leads extending therefrom, said socket comprising:

a) a first member for receiving an integrated circuit package, and and having a plurality of holes for receiving leads extending from the package, and b) a second member having a plurality of wires anchored on the second member and arranged in two parallel partially interdigitated sets with each wire cooperating with a hole for engaging a lead of the integrated circuit, thereby increasing working distance from a lead contact point on each wire to an anchor point on the interdigitated portion of each wire.

7. The socket as defined by claim 6 wherein the first member is laterally translatable with respect to the second member.

8. The socket as defined by claim 6 wherein the first member and the second member form a unitary structure.

9. The socket as defined by claim 6 wherein each hole is larger than a lead whereby the leads can be inserted into the holes with minimal insertion force.

10. The socket as defined by claim 9 wherein each hole has a circular cross section.

11. The socket as defined by claim 10 wherein the first member is laterally translatable with respect to the second member.

* * * * *